United States Patent [19]

Boiten et al.

[11] 4,258,470

[45] Mar. 31, 1981

[54] SHAVING APPARATUS

[75] Inventors: Ebbe Boiten; Jochem J. de Vries, both of Drachten, Netherlands

[73] Assignee: U.S. Philips Corporation, New York, N.Y.

[21] Appl. No.: 946,885

[22] Filed: Sep. 28, 1978

[30] Foreign Application Priority Data

Nov. 28, 1977 [NL] Netherlands ..... 7713041

[51] Int. Cl.[3] ..... B26B 19/14

[52] U.S. Cl. ..... 30/43.6; 30/346.51; 30/34.2

[58] Field of Search ..... 30/34.2, 43.4–43.42, 30/346.51; 76/104 R

[56] References Cited

U.S. PATENT DOCUMENTS

| | | | |
|---|---|---|---|
| 3,088,205 | 5/1963 | Ellis | 30/43.6 X |
| 3,962,784 | 6/1976 | Tietjens | 30/346.51 X |
| 4,151,645 | 5/1979 | Tietjens | 30/346.51 X |

FOREIGN PATENT DOCUMENTS

| | | | |
|---|---|---|---|
| 7410160 | 2/1976 | Netherlands | 76/104 R |

*Primary Examiner*—Gary L. Smith

*Attorney, Agent, or Firm*—T. A. Briody; W. J. Streeter; R. E. Schneider

[57] ABSTRACT

A shaving apparatus has a circular shear plate provided with hair-entrance apertures and a cutting unit associated with and rotatable relative to the shear plate. The cutting unit comprises a cutting member having a circular central body and a hair-pulling member having a circular central portion. Cutters extend from the central body circumference toward the shear plate, with each cutter having a guide wall. A lead cutter is associated with and movable along the guide wall of each cutter, the lead cutter being connected to the central portion circumference by a V-shaped elastically deformable arm. One link of the connecting arm is secured to the central portion and extends tangentially therefrom; and the other limb is connected to the lead cutter. Each connecting arm is elastically deformed so as to urge its lead cutter against the guide wall of the associated cutter.

6 Claims, 10 Drawing Figures

SHAVING APPARATUS

This invention relates to a shaving apparatus having a circular shear plate with hair-entrance apertures and a cutting unit which is rotatable relative to the shear plate, which cutting unit comprises a cutting member having a circular central body which is provided with cutters, each cutter having an associated lead cutter which is movable along a guide wall of the cutter, which lead cutter is connected to the central body by means of a connecting arm.

Such a shaving apparatus is for example known from U.S. Pat. No. 3,962,784.

It is the object of the present invention to provide an improved construction which is less susceptible to dimensional tolerances and suitable for mass production, and the invention is characterized in that a lead cutter is urged against its associated cutter guide wall owing to elastic deformation of the connecting arm.

For the proper operation of the cutting unit it is of importance that all lead cutters directly engage with the respective guide walls of the associated cutters. However, this demands a high manufacturing accuracy of the components of the cutting unit, in particular if the lead cutters are combined into one component. However, by making the lead cutters in the rest position engage with the cutter guide walls under so-called pretension and employing the elastic deformation of the connecting arms, greater dimensional tolerances for the lead cutters and the cutting member are permissible.

A preferred embodiment is characterized in that the force which is exerted on a lead cutter by its connecting arm owing to such elastic deformation has a component which is normal to the associated cutter guide wall and a component which is directed along the cutter guide wall in the direction of the shear plate.

A further elaboration is characterized in that the connecting arm is substantially V-shaped, the end of a first limb of the V being secured to the central body and said limb extending in a substantially tangential direction relative to the cutting member, and the second limb being elastically deformable and being connected to the lead cutter.

A related embodiment is characterized in that during movement along the cutter guide wall in a direction away from the shear plate the associated lead cutter is rotatable about a point near the end of the first limb which is secured to the central body and the forces exerted on the lead cutter by the cutter produce a counteracting torque.

The two limbs of the V-shaped connecting arm may then for example be elastically deformable.

A preferred embodiment of a shaving apparatus of the type described in the foregoing, the lead cutters being connected to a circular central portion by means of respective connecting arms, which central portion is secured to the central body of the cutting member, is characterized in that by means of a cam-hole joint the central body of the cutting member and such central portion are locked against rotation relative to each other owing to the forces between the cutter and the lead cutter.

A special embodiment of the construction in accordance with the preceding paragraph is characterized in that at least one cam is formed by an offset tab of the central portion, the tab engaging a corresponding opening in the central body of the cutting member.

Another special embodiment is characterized in that the central body of the cutting member is provided with at least one cam which engages with a corresponding opening in the central portion.

A preferred embodiment is characterized in that the cam is undercut.

The invention is also embodied in a cutting unit employed in one of the embodiments of a shaving apparatus as defined hereinbefore.

The invention will now be described in detail in connection with the accompanying drawings, in which.

Figure 6:
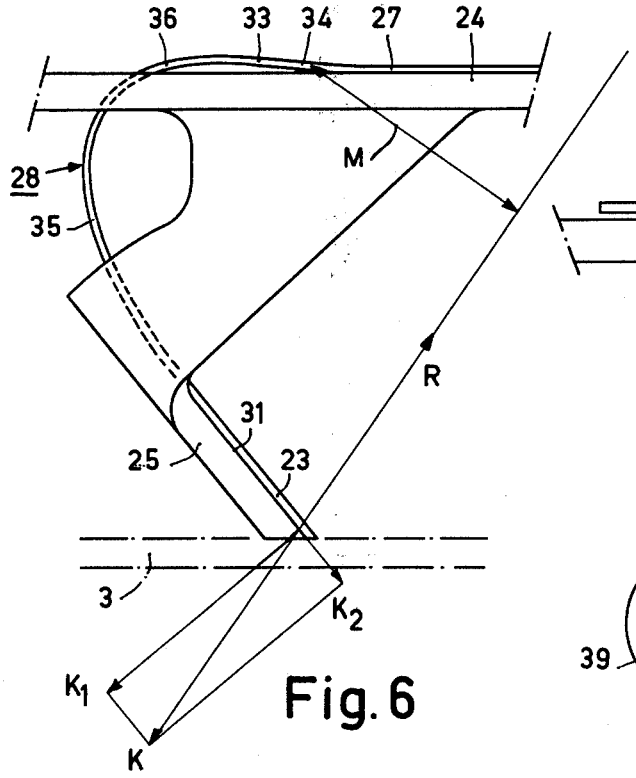
FIG. 6 shows on an enlarged scale a detail of the cross-section of FIG. 5.
Figure 7:
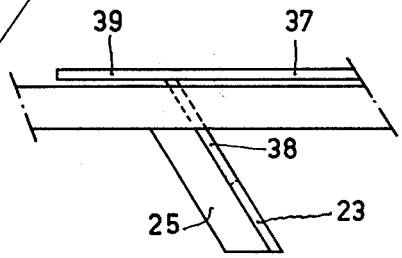

FIG. 7 in a similar way as FIG. 6 shows a detail of a different embodiment.

Figure 8:
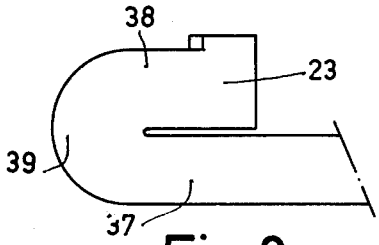

FIG. 8 is a plan view of the detail of FIG. 7.

Figure 9:
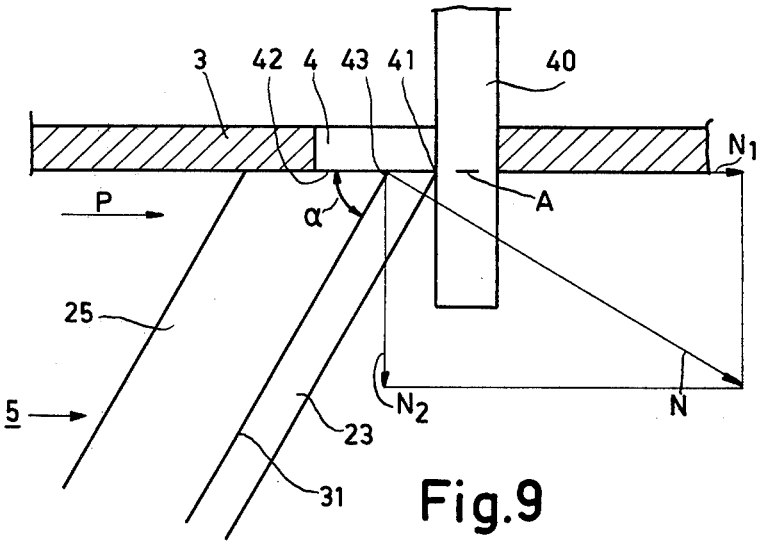
Figure 10:
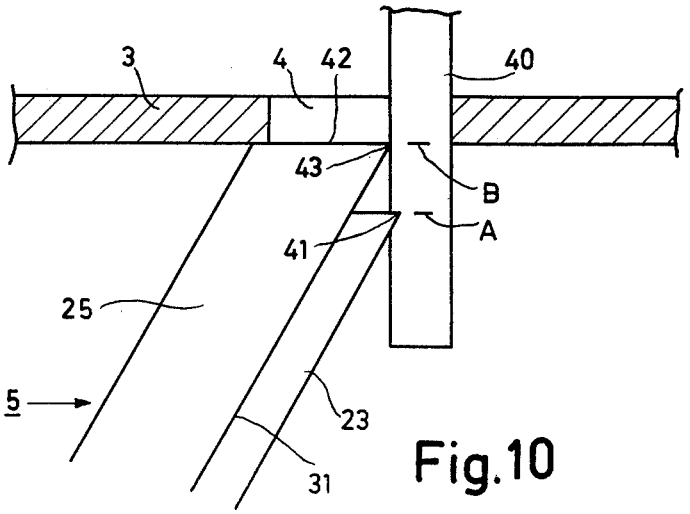

FIGS. 9 and 10 illustrate on an enlarged scale the operation of a lead cutter.

Figure 1:
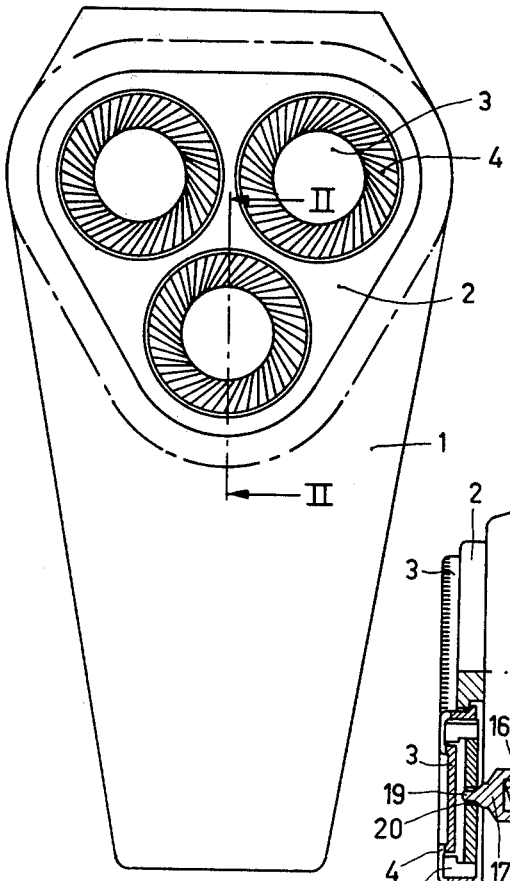
FIG. 1 shows an elevation of a shaving apparatus having three shear plates.
Figure 2:
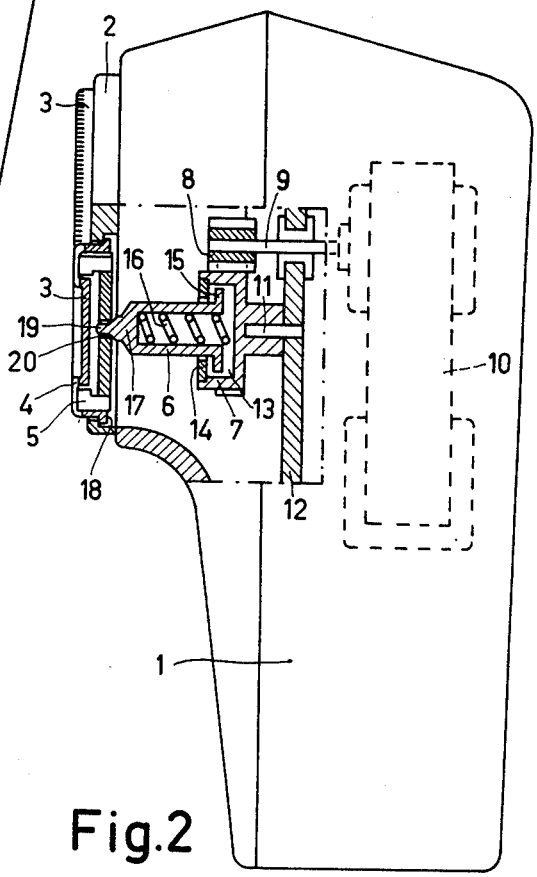
FIG. 2 shows the shaving apparatus of FIG. 1 in side view and partly in a cross-section taken on the line II—II in FIG. 1.
Figure 3:
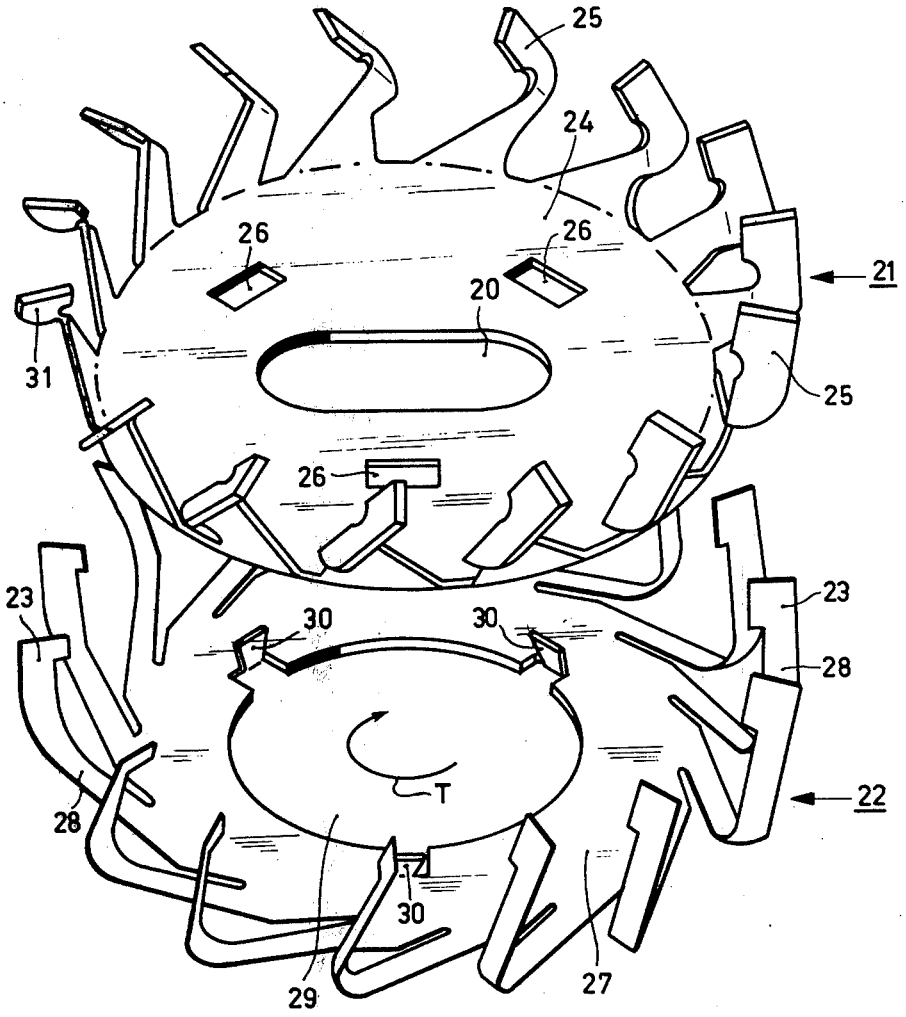
FIG. 3 shows the cutting unit in disassembled condition in perspective on an enlarged scale.
Figure 4:
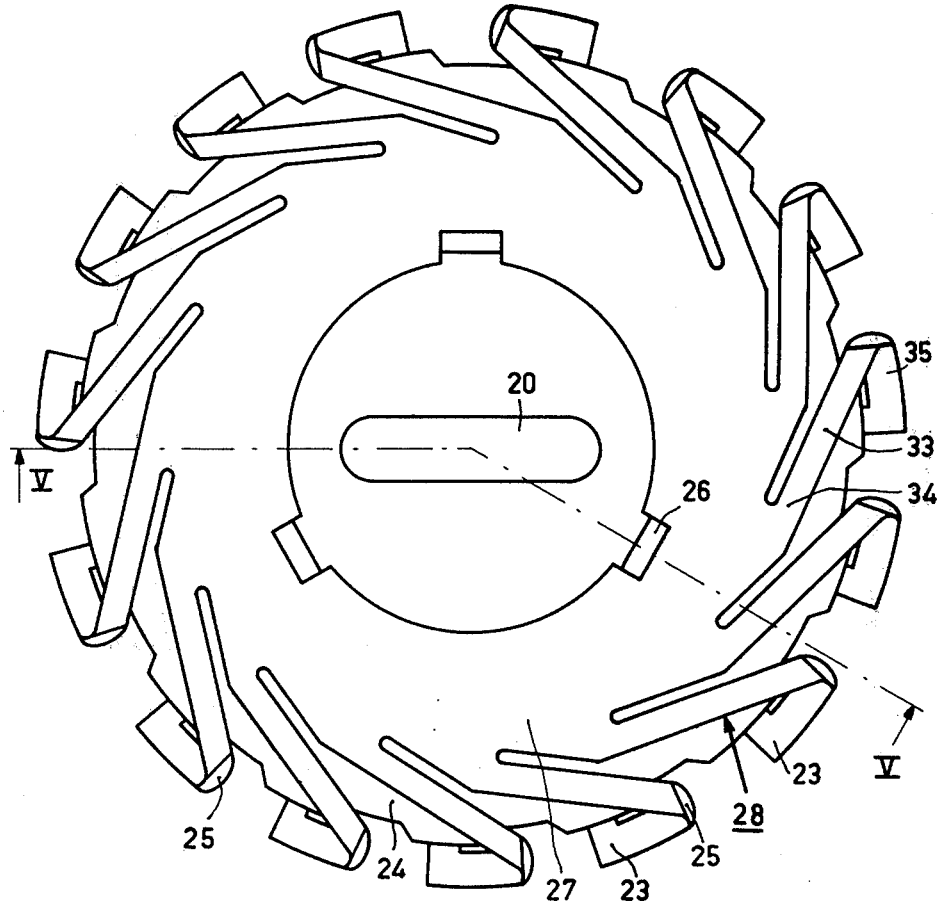
FIG. 4 shows a plan view of the components shown in FIG. 3 assembled into a cutting unit.

The shaving apparatus of FIGS. 1 and 2 comprises a housing 1, of which a part takes the form of a shear-plate holder 2 for three shear plates 3. The shear plates 3 have hair-entrance apertures 4.

As shown in the partial cross-section of FIG. 2 a cutting unit 5 is situated on the inner side of a shear plate 3. This cutting unit 5, which for the sake of clarity is only shown schematically in FIG. 2, comprises a cutting member and lead cutters, and is shown in detail on an enlarged scale in FIGS. 3 to 6.

The cutting unit 5 is coupled to the electric motor 10 by means of the hollow spindle 6 (FIG. 2), the gear wheels 7 and 8 and the spindle 9, so that the cutting unit is rotatable relative to the associated shear plate 3. The gear wheel 7 is rotatably journalled on a pin 11 which is mounted in a mounting plate 12. The gear wheel 7 has a recess 13 which is closed by a cover plate 14. This recess accommodates the flange 15 at the end of the hollow spindle 6. By giving the flange 15 a non-round, for example square, shape and by shaping the recess 13 accordingly, a coupling is obtained for the transmission of the rotary movement of the gear wheel 7 to the spindle 6. The spring 16, which for its greater part is disposed in the hollow spindle 6 and which is tensioned between the hollow spindle 6 and the gear wheel 7, exerts a force on the spindle 6 in the direction of the cutting unit 5. As the cylindrical portion 17 of the spindle 6 bears against the cutting unit 5 this force is exerted on the cutting unit and via the cutting unit on the shear plate 3, so that the shear plate is pressed against the shear-plate holder 2 along its flanged edge 18. As a result of external forces, as may for example occur during use of the shaving apparatus, the shear plate 3 together with the cutting unit 5 and the spindle 6 can be pressed inwards against the action of the spring 16.

The coupling for the transmission of the rotary movement between the spindle 6 and the cutting unit 5 is obtained in that the spindle 6 has an end 19 of substantially rectangular cross-section. This end 19 engages with a corresponding coupling opening 20 in the cutting unit 5.

The coupling to the electric motor 10 as described in the foregoing is identical for the three cutting units of the apparatus in accordance with FIGS. 1 and 2, the three gear wheels 7 being in engagement with a single centrally disposed gear wheel 8 on the motor spindle 9.

The cutting unit 5 (FIGS. 3 through 6) comprises a cutting member 21 and a hair-pulling member 22 with lead cutters 23.

The cutting member 21 is substantially constituted by a central body 24 which is provided with cutters 25 at its circumference. The central body 24 has the coupling opening 20 and three recesses 26.

The hair-pulling member 22 comprises a central portion 27 to which the lead cutters 23 are connected by means of the connecting arms 28. The central portion 27 has a central opening 29. Preferably, the hair-pulling member is integrally manufactured from a sheet material. The cams 30 are respectively formed by three tabs which are offset from the plane of the central portion 27. The cutting member 21 and the hair-pulling member 22 with its lead cutters 23 can be assembled into a cutting unit 5 in a simple manner. For this purpose the two members 21 and 22 are assembled in such a way that each lead cutter 23 engages the guide wall 31 of the associated cutter 25. This occurs already before the central plate-shaped portion 27 has contacted the central body 24. By rotating the hair-pulling member 22 relative to the cutting member 21 in the direction of the arrow T, it is achieved that the connecting arms 28 are elastically deformed and the lead cutters 23 are urged against their associated cutter guide walls 31. Upon rotation of the two components relative to each other the cams 30 are disposed opposite the recesses 26 and the components 21 and 22 can be brought further together until the central body 24 is positioned against the central portion 27. The cams 30 are then situated in the recesses 26 and prevent the cutting member 21 and the hair-pulling member 22 from being rotated relative to each other under the influence of the forces obtaining between the cutters and the lead cutters. Thus, it is achieved that despite dimensional tolerances, which for example arise during manufacture of the hair-pulling member or the cutting member, or owing to tolerances in the dimensions of these components, all lead cutters still engage their associated cutters.

Figure 5:
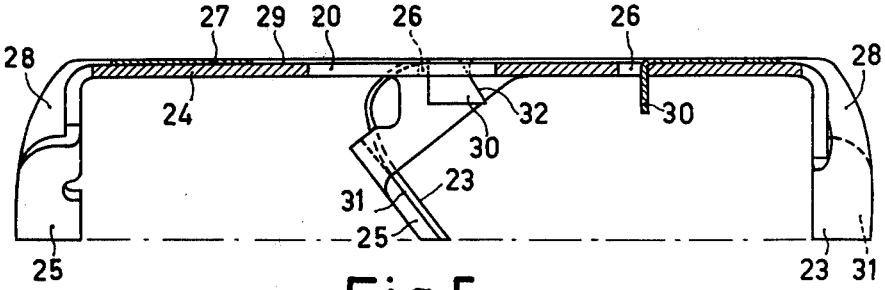
FIG. 5 is a cross-section taken on the line V—V in FIG. 4.

For the sake of clarity FIG. 5 only shows three cutters with their associated lead cutters. The cams 30 are slightly undercut as is indicated by the oblique side 32. This also provides a simple detachable connection between the cutting member 21 and the hair-pulling member 22. The central body 24 and the central plate-shaped portion 27 can also be fixed to each other in known manner, for example by glueing or spot-welding.

Obviously, it is also possible to form the cams of the cam-hole connection on the central body 24 of the cutting member 21 and to form corresponding openings in the central portion 27 of the hair-pulling member.

The central cutter of the three cutters shown in FIG. 5 is shown on an enlarged scale in FIG. 6. As is shown in FIG. 6, the connecting arm 28 is substantially V-shaped with a first limb 33 which at the end 34 is connected to the central portion 27 and via said central portion to the central body 24 of the cutting member 21. The limb 33 extends in a substantially tangential direction relative to the cutting member, as can be seen in FIG. 5. At one end the second limb 35 is connected to the lead cutter 23. Owing to the elastic deformation of the connecting arm 28, which implies bending of the limbs 33 and 35 and bending of the elbow 36 which forms the connection between the limbs 33 and 35, the lead cutter 23 is urged against the guide wall 31. As a result, the lead cutter 23 will exert a force K on the cutter, which is generally composed of a force $K_1$ normal to the guide wall 31 and a force $K_2$ along the guide wall in the direction of the shear plate 3, which is schematically shown by interrupted lines in FIG. 6.

The force $K_2$ can be counteracted by a frictional force between the guide wall 31 and the lead cutter 23 or by a reaction force exerted on the lead cutter by the shear plate 3, so that the resulting reaction force R exerted on the lead cutter by the cutter 25 and, as the case may be by the shear plate 3, is equal to but directed oppositely to force K and provides an equilibrium.

During operation the lead cutter 23 will be subject to a slight displacement along the guide wall 31 in a direction substantially away from the shear plate 3. Owing to the flexibility of the first limb 33 this displacement may be considered approximately as a rotation about the end 34. The resulting reaction force R has a moment arm M relative to said end 34, so that a counteracting torque is produced as a result of which the lead cutter 23 returns to the position shown in FIG. 6 once the cause of the displacement no longer exists.

During the displacement the moment arm M will slightly decrease, but the resulting reaction force R will increase, for example owing to further deformation of the elbow 36 and the second limb 35, so that the torque remains substantially constant. The advantage is that the first limb 33 may take the form of a comparatively weak leaf spring, so that during said displacement of the lead cutter owing to the elastic deformation of the first limb 33 no great counteracting forces are produced, whilst yet a sufficiently large force or torque is available to return the lead cutter to the initial position shown in FIG. 6.

The first limb 33 may also take the form of a rigid part of the connecting arm 28, which part is pivotally connected to the central body 24 at the end 34.

In the embodiment of FIGS. 7 and 8 the connecting arm is also substantially V-shaped and comprises a first limb 37 and a second limb 38. The two limbs are connected by an elbow 39 which is entirely disposed in the plane of the first limb 37. For the sake of simplicity the cutter 25, which is shown schematically in FIG. 7, has been omitted in FIG. 8. This construction of the lead cutter with its connecting arm can be manufactured very simply and has virtually the same properties as that in accordance with FIGS. 3 through 6.

FIGS. 9 and 10 schematically show a side view of a part of the cutting unit 5 and a part of the shear plate 3 and serve to illustrate the operation of the lead cutters. When a hair 40 is caught in a hair-entrance aperture 4 this hair will soon come into contact with the sharp edge 41 of the lead cutter 23 at the location A, owing to the rotary movement of the cutter 25 and the lead cutter 23. The sharp edge is such that it will slightly penetrate the hair 40, but without cutting off the hair. The reaction force which is exerted on the lead cutter 23 by the hair 40 will be directed oppositely to the direction of movement P. This force is compensated for by the component $N_1$ of the normal force N which is exerted on the lead cutter 23 by the guide wall 31 of the cutter 25 (FIG. 9). For simplicity the slight frictional forces between the lead cutter 23 and the cutter 25 have been neglected. The component $N_2$ of the normal force N will cause the lead cutter 23 to slide along the guide wall 31. The angle α between the guide end 31 and the wall 42 of the cutter 25 which engages with the shear plate 3 should be smaller than 90°.

Owing to inter alia the natural elasticity of the skin the hair 40 will be moved along by the lead cutter 23 until the cutting edge 43 of the cutter 25 has reached the hair at the location B (FIG. 10). Subsequently, the hair will be cut by cooperation of the shear plate 3 and the cutter 25. Thus a part of the hair 40 is cut which is longer than the part which would be cut without the lead cutter by a length equal to the distance between A and B, so that a better shaving result is obtained.

What is claimed is:

1. A shaving apparatus having a circular shear plate provided with hair-entrance apertures and a cutting unit associated with and rotatable relative to the shear plate; said cutting unit comprising a cutting member having a circular central body, cutters extending from the circumference of said central body toward the shear plate, each such cutter having a guide wall, a hair-pulling member having a circular central portion, lead cutters respectively associated with and movable relative to the cutters along their respective guide walls, and elastically deformable substantially V-shaped connecting arms respectively securing said lead cutters to said central portion along its circumference, one limb of each connecting arm being secured at its end to said central portion and extending in a substantially tangential direction from said central portion, the other limb being connected at its end to the associated lead cutter, each connecting arm being sufficiently elastically deformed so as to urge its respective lead cutter against the guide wall of the associated cutter, the force thereby exerted on each lead cutter by such elastic deformation of the connecting arm having a component normal to said guide wall and a component directed along said guide wall in the direction of the shear plate.

2. A shaving apparatus according to claim 1, in which each lead cutter is mounted for rotation about a point near the end of said one limb during its movement along the guide wall of the associated cutter in a direction away from the shear plate.

3. A shaving apparatus according to claim 1, in which the central portion of the hair-pulling member is secured to the central body of the cutting member by means of a cam-hole joint in order to lock the cutting member and the hair-pulling member against rotation relative to each other as a result of the forces exerted between each cutter and its associated lead cutter.

4. A shaving apparatus according to claim 3, in which at least one opening is formed in one of said central body and said central portion, and at least one tab is formed in the other of said central body and said central portion for engagement with said opening.

5. A shaving apparatus according to claim 4, in which said tab is formed in the central body, and said opening is formed in the central portion.

6. A shaving apparatus according to claim 5, in which the tab is undercut.

* * * * *